US010423115B2

(12) United States Patent
Tetsuno et al.

(10) Patent No.: US 10,423,115 B2
(45) Date of Patent: Sep. 24, 2019

(54) IMAGE FORMING APPARATUS

(71) Applicant: CANON KABUSHIKI KAISHA, Tokyo (JP)

(72) Inventors: Shuichi Tetsuno, Kawasaki (JP); Shinji Katagiri, Yokohama (JP); Tsuguhiro Yoshida, Yokohama (JP); Koji An, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/154,543

(22) Filed: Oct. 8, 2018

(65) Prior Publication Data

US 2019/0113881 A1 Apr. 18, 2019

(30) Foreign Application Priority Data

Oct. 13, 2017 (JP) ..... 2017-199624

(51) Int. Cl.
*G03G 15/16* (2006.01)
*G03G 15/00* (2006.01)
*G03G 15/01* (2006.01)

(52) U.S. Cl.
CPC ..... *G03G 15/80* (2013.01); *G03G 15/0189* (2013.01); *G03G 15/1675* (2013.01); (Continued)

(58) Field of Classification Search
CPC ..... G03G 15/80; G03G 15/0189; G03G 15/1675; G03G 15/1685; G03G 15/5004; G03G 2215/017; G03G 2215/1661
See application file for complete search history.

(56) References Cited

U.S. PATENT DOCUMENTS

2013/0064565 A1* 3/2013 Yasukawa ..... H02M 7/103 399/88
2013/0259506 A1* 10/2013 Katagiri ..... G03G 15/1675 399/66
2013/0259543 A1* 10/2013 Katagiri ..... G03G 15/5004 399/302

(Continued)

FOREIGN PATENT DOCUMENTS

JP 2012-137733 A 7/2012
JP 2014-202772 A 10/2014
JP 2016-109875 A 6/2016

*Primary Examiner* — David J Bolduc
(74) *Attorney, Agent, or Firm* — Canon USA, Inc. IP Division

(57) ABSTRACT

An image forming apparatus including an image carrying member, an intermediate transfer belt having conductivity, a toner image on the image carrying member being primarily transferred to the intermediate transfer belt, a secondary transfer member in contact with an outer peripheral surface of the intermediate transfer belt, the secondary transfer member secondarily transferring the toner image on the intermediate transfer belt to a transfer material, a power supply applying a voltage to the secondary transfer member, the toner image being primarily transferred from the image carrying member to the intermediate transfer belt by having a voltage be applied to the secondary transfer member from the power supply, a contact member in contact with the intermediate transfer belt, and a constant current diode, an anode side thereof being connected to the power supply, and a cathode side thereof being connected to the contact member.

19 Claims, 5 Drawing Sheets

(52) U.S. Cl.
CPC ..... *G03G 15/1685* (2013.01); *G03G 15/5004* (2013.01); *G03G 2215/017* (2013.01); *G03G 2215/1661* (2013.01)

(56) References Cited

U.S. PATENT DOCUMENTS

| | | | | |
|---|---|---|---|---|
| 2013/0328992 | A1* | 12/2013 | Hayakawa | G03G 15/80 347/224 |
| 2014/0294414 | A1* | 10/2014 | Minato | G03G 15/161 399/66 |
| 2015/0003880 | A1* | 1/2015 | Ohno | G03G 15/80 399/302 |
| 2015/0023680 | A1* | 1/2015 | Nakaegawa | G03G 15/1605 399/66 |
| 2015/0098719 | A1* | 4/2015 | Ishizumi | G03G 15/5058 399/49 |
| 2015/0185666 | A1* | 7/2015 | Nakaegawa | G03G 15/1665 399/66 |
| 2015/0212457 | A1* | 7/2015 | Kanno | G03G 15/1605 399/66 |
| 2016/0048096 | A1* | 2/2016 | Katagiri | G03G 15/0189 399/66 |
| 2016/0147183 | A1* | 5/2016 | Kanno | G03G 15/1675 399/66 |
| 2017/0146943 | A1* | 5/2017 | Ito | G03G 15/5004 |
| 2017/0205754 | A1* | 7/2017 | Tabata | G03G 15/1605 |
| 2017/0343916 | A1* | 11/2017 | Tanaka | G03G 15/0121 |
| 2018/0032001 | A1* | 2/2018 | Yoshida | G03G 15/0131 |
| 2018/0032023 | A1* | 2/2018 | Shimizu | G03G 15/80 |
| 2018/0039198 | A1* | 2/2018 | Saito | G03G 15/0121 |
| 2018/0039209 | A1* | 2/2018 | Ishizumi | G03G 15/1605 |
| 2018/0157195 | A1* | 6/2018 | Iida | G03G 15/161 |
| 2018/0181033 | A1* | 6/2018 | Minobe | G03G 15/1675 |
| 2018/0181051 | A1* | 6/2018 | Yoshida | G03G 15/161 |

* cited by examiner

IMAGE FORMING APPARATUS

BACKGROUND OF THE INVENTION

Field of the Invention

The present disclosure relates to an image forming apparatus, such as a copier, printer, or a facsimile, which forms an image through an electrophotographic process.

Description of the Related Art

A configuration of an electrophotographic system color image forming apparatus is known in which toner images are sequentially transferred from image forming units of various colors to an intermediate transfer member, and the toner images are transferred all at once from the intermediate transfer member to a transfer material.

In such an image forming apparatus, the image forming units of various colors each include a drum-shaped photosensitive member (hereinafter, referred to as a photosensitive drum) serving as an image carrying member. The toner images formed on the photosensitive drums of the image forming units are primarily transferred onto the intermediate transfer member by having a voltage be applied from a primary transfer power supply to a primary transfer member provided so as to oppose the photosensitive drums with the intermediate transfer member such as an intermediate transfer belt interposed therebetween. The toner images of various colors that have been primarily transferred from the image forming units of various colors to the intermediate transfer member are secondarily transferred all at once onto a transfer material, such as a sheet of paper or an OHP sheet, from the intermediate transfer member by having a voltage be applied at the secondary transfer portion from the secondary transfer power supply to the secondary transfer member. The toner colors of various colors transferred to the transfer material are subsequently fixed to the transfer material with a fixing unit.

Japanese Patent Laid-Open No. 2012-137733 discloses a configuration in which, in order to achieve reduction of size and cost of an image forming apparatus, a primary transfer power supply is not provided and primary transfer is performed by distributing an electric current through an intermediate transfer member in a circumferential direction thereof by applying a voltage to a secondary transfer member from a secondary transfer power supply.

In the configuration in Japanese Patent Laid-Open No. 2012-137733, the primary transfer characteristics are influenced by the electric current flowing towards the primary transfer portion through the secondary transfer portion. For example, in a case in which the electric current flowing from the secondary transfer portion towards the primary transfer portion falls below a predetermined value due to a change in the ambient environment of the image forming apparatus or in the electric resistance of the transfer material, the electric current needed for primary transfer becomes insufficient and a transfer defect may occur in the primary transfer portion.

SUMMARY OF THE INVENTION

Accordingly, the present disclosure provides, in an image forming apparatus that performs primary transfer by distributing an electric current in the circumferential direction of the intermediate transfer member, a satisfactory primary transfer characteristic.

An image forming apparatus of the present disclosure includes an image carrying member that carries a toner image, an endless and movable intermediate transfer belt having conductivity, the toner image on the image carrying member being primarily transferred to the intermediate transfer belt, a secondary transfer member in contact with an outer peripheral surface of the intermediate transfer belt, the secondary transfer member secondarily transferring the toner image on the intermediate transfer belt to a transfer material, a power supply that applies a voltage to the secondary transfer member, the toner image being primarily transferred from the image carrying member to the intermediate transfer belt by having a voltage be applied to the secondary transfer member from the power supply, a contact member in contact with the intermediate transfer belt, and a constant current diode, an anode side of the constant current diode being connected to the power supply, and a cathode side of the constant current diode being connected to the contact member.

Further features of the present disclosure will become apparent from the following description of exemplary embodiments with reference to the attached drawings.

DESCRIPTION OF THE EMBODIMENTS

Figure 1:
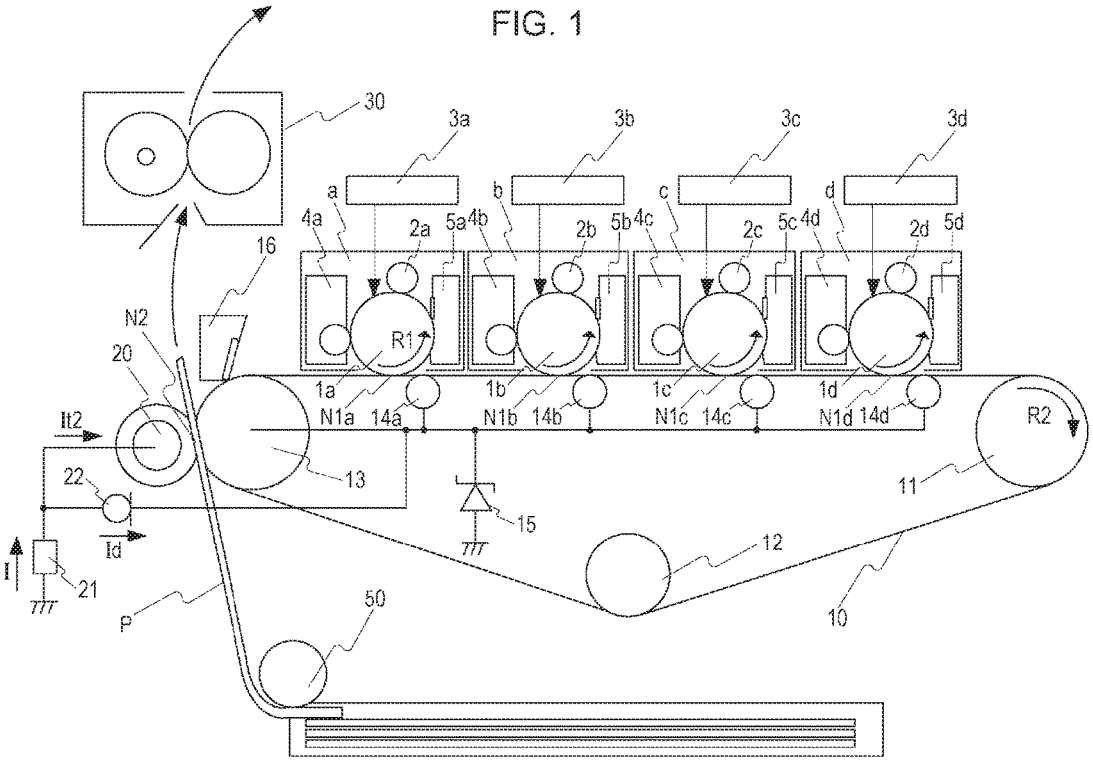
FIG. 1 is a schematic cross-sectional view illustrating an image forming apparatus according to a first exemplary embodiment.

Hereinafter, referring to the drawings, preferred exemplary embodiments of the present disclosure will be exemplified in detail. Note that the dimensions, the materials, and the shapes of the components and the relative configuration of the components, and the like that are described in the following exemplary embodiments are to be appropriately changed based on the device, to which the present disclosure is applied, and on various conditions. Accordingly, unless otherwise specified in particular, the scope of the present disclosure is not intended to be limited by the exemplary embodiments.

First Exemplary Embodiment

Configuration of Image Forming Apparatus

FIG. 1 is a schematic cross-sectional view illustrating a configuration of an image forming apparatus of the present exemplary embodiment. Note that the image forming apparatus of the present exemplary embodiment is a so-called tandem type image forming apparatus provided with a plurality of image forming units a to d. Images are formed with toner of various colors and the first image forming unit a forms an image with yellow (Y) toner, the second image forming unit b with magenta (M) toner, the third image forming unit c with cyan (C) toner, and the fourth image forming unit d with black (Bk) toner. The four image forming units are disposed in a line at constant intervals. Other than the color of the accommodated toner, the image forming units are configured with many portions that are practically the same. Accordingly, the image forming apparatus of the present exemplary embodiment will be described hereinafter using the first image forming unit a.

The first image forming unit a includes a photosensitive drum 1*a* that is a drum-shaped photosensitive member, a charge roller 2*a* that is a charging member, a developing unit 4*a*, and a drum cleaning unit 5*a*.

The photosensitive drum 1*a* is an image carrying member that carries a toner image and is rotationally driven in an arrow R1-direction illustrated in the drawing at a predetermined circumferential velocity (a processing speed). The developing unit 4*a* accommodates yellow toner, and develops the yellow toner onto the photosensitive drum 1*a*. The drum cleaning unit 5*a* is a unit that collects the toner attached to the photosensitive drum 1*a*. The drum cleaning unit 5*a* includes a cleaning blade that comes in contact with the photosensitive drum 1*a*, and a residual toner box that accommodates the toner that has been removed from the photosensitive drum 1*a* with the cleaning blade.

By having a control unit (not shown) such as a controller receive an image signal, an image forming operation is started and the photosensitive drum 1*a* is rotationally driven. While the photosensitive drum 1*a* is being rotated, the charge roller 2*a* performs a charging process on the photosensitive drum 1*a* and uniformly charges the photosensitive drum 1*a* to a predetermined voltage (a charging voltage) having a predetermined polarity (a negative polarity in the present exemplary embodiment), and the exposure unit 3*a* exposes the photosensitive drum 1*a* according to the image signal. With the above, an electrostatic latent image according to a yellow component image in the intended color image is formed on the photosensitive drum 1*a*. Subsequently, the electrostatic latent image is developed at a developing position with the developing unit 4*a* and is visualized on the photosensitive drum 1*a* as a yellow toner image. Note that a normal charge polarity of the toner accommodated in the developing unit 4*a* is a negative polarity, and the electrostatic latent image is developed in a reversed manner with toner charged by the charge roller 2*a* to have the same charge polarity with that of the photosensitive drum 1*a*. However, not limited to the above, the present disclosure can be applied to an image forming apparatus that performs positive development of the electrostatic latent image with toner that has been charged to a polarity opposite to the charge polarity of the photosensitive drum 1*a*.

An endless and movable intermediate transfer belt 10 is conductive and forms a primary transfer portion N1*a* by contacting the photosensitive drum 1*a*. The intermediate transfer belt 10 rotates at a circumferential velocity that is substantially the same as that of the photosensitive drum 1*a*. Furthermore, the intermediate transfer belt 10 is stretched by an opposed roller 13 serving as an opposing member, and a driving roller 11 and a stretching roller 12 serving as stretching members. The intermediate transfer belt 10 is stretched at a tension amounting to a total pressure of 60 N with the stretching roller 12. The intermediate transfer belt 10 can be moved by rotationally driving the driving roller 11 in an arrow R2-direction illustrated in the drawing.

In the course of passing through the primary transfer portion N1*a*, the yellow toner image formed on the photosensitive drum 1*a* is primarily transferred onto the intermediate transfer belt 10 from the photosensitive drum 1*a*. Primary transfer residual toner remaining on a surface of the photosensitive drum 1*a* is removed by the drum cleaning unit 5*a* and is, in the image forming process, used in the charging step and after.

During primary transfer, an electric current is fed to the conductive intermediate transfer belt 10 from a secondary transfer roller 20 serving as a secondary transfer member in contact with an outer peripheral surface of the intermediate transfer belt 10. By having the electric current fed from the secondary transfer roller 20 flow in a circumferential direction of the intermediate transfer belt 10, the toner image is primarily transferred from the photosensitive drum 1*a* to the intermediate transfer belt 10. In so doing, a voltage having a predetermined polarity (a positive polarity in the present exemplary embodiment) that is opposite to the normal charge polarity of the toner is applied from a transfer power supply 21 to the secondary transfer roller 20.

Hereinafter, in a similar manner, a toner image formed of a second color, magenta, a toner image formed of a third color, cyan, and a toner image formed of a fourth color, black, are formed and are transferred onto the intermediate transfer belt 10 in a sequential manner so as to overlap each other. With the above, a toner image including four colors corresponding to the intended color image is formed on the intermediate transfer belt 10. Subsequently, the four-colored toner image carried on the intermediate transfer belt 10 is secondarily transferred all at once onto a surface of a transfer material P, such as a sheet of paper or an OHP sheet, fed from a sheet feeding unit 50, in the course of passing through a secondary transfer portion N2 formed by the secondary transfer roller 20 and the intermediate transfer belt 10 in contact with each other.

The secondary transfer roller 20 uses a member that has an outside diameter of 18 mm in which a nickel plated steel bar having an outside diameter of 8 mm is covered with a foam sponge body, having as the main components NBR and epichlorohydrin rubber, adjusted to have a volume resistivity of $10^8$ Ω·cm and a thickness of 5 mm. Note that the rubber hardness of the foam sponge body applied with a load of 500 g is 30° when measured using an ASKER Durometer Type C. The secondary transfer roller 20 is in contact with the outer peripheral surface of the intermediate transfer belt 10, and forms the secondary transfer portion N2 by pressing, at a pressure of 50 N, the opposed roller 13 serving as an opposing member with the intermediate transfer belt 10 interposed therebetween.

The secondary transfer roller 20 is rotated by following the movement of the intermediate transfer belt 10. By applying a voltage to the secondary transfer roller 20 from the transfer power supply 21, an electric current flows from the secondary transfer roller 20 towards the opposed roller 13 serving as an opposing member. With the above, the toner image that has been carried on the intermediate transfer belt 10 is secondarily transferred onto the transfer material P at the secondary transfer portion N2. Note that while the toner image on the intermediate transfer belt 10 is secondarily transferred onto the transfer material P, the voltage applied from the transfer power supply 21 to the secondary transfer roller 20 is controlled so that the electric current flowing from the secondary transfer roller 20 towards the opposed roller 13 with the intermediate transfer belt 10 interposed therebetween is uniform. Furthermore, the size of the electric current for secondary transfer is predetermined based on the ambient environment of the installed image forming apparatus and the type of transfer material P. The transfer power supply 21 is connected to the secondary transfer roller 20, and applies a transfer voltage to the secondary transfer roller 20. Furthermore, the transfer power supply 21 is capable of outputting a voltage from 100 [V] to 4000 [V].

The transfer material P on which the four-colored toner image has been secondarily transferred is, subsequently, heated and compressed at a fixing unit 30 so that the toner of four colors are melted and mixed and is fixed to the transfer material P. The toner remaining on the intermediate transfer belt 10 after the secondarily transfer is removed by a belt cleaning unit 16 provided so as to oppose the opposed roller 13 with the intermediate transfer belt 10 interposed therebetween. The belt cleaning unit 16 includes a cleaning blade that is in contact with the outer peripheral surface of the intermediate transfer belt 10, and a waste toner container that accommodates toner and the like removed from the intermediate transfer belt 10 with the cleaning blade.

In the image forming apparatus of the present exemplary embodiment, a full-color printed image is formed with the above operation.

The intermediate transfer belt 10, the opposed roller 13 serving as the opposing member, the driving roller 11 and the stretching roller 12 serving as the stretching members, and metal rollers 14*a*, 14*b*, 14*c*, and 14*d* (hereinafter, each merely referred to as each metal roller 14) serving as contact members will be described next. In the present exemplary embodiment, the opposed roller 13 and each metal roller 14 are electrically connected to each other. In the description hereinafter, each of the photosensitive drums 1*a*, 1*b*, 1*c*, and 1*d* will merely be referred to as each photosensitive drum 1, and each of the primary transfer portions N1*a*, N1*b*, N1*c*, and N1*d* will merely be referred to as each primary transfer portion N1.

The intermediate transfer belt 10 is an endless belt employing polyimide resin mixed with carbon as a conducting agent, and has a circumferential length of 700 mm, a length of 240 mm in an axial direction, and a thickness of 90 μm, and in the present exemplary embodiment, the volume resistivity of the intermediate transfer belt 10 is $1\times10^{9}$ Ω·cm. Note that the volume resistivity is measured using Hiresta-UP (MCP-HT450) and a ring probe, type UR (model MCP-HTP12) manufactured by Mitsubishi Chemical Corporation. During the measurement, the room temperature is set to 23° C., the room humidity is set to 50%, the applied voltage is 100V, and the measuring time is 10 seconds.

In a moving direction of the intermediate transfer belt 10, each metal roller 14 is disposed at a position that corresponds to the corresponding photosensitive drum 1. Each metal roller 14 is in contact with an inner peripheral surface of the intermediate transfer belt 10 at a portion near the corresponding photosensitive drum 1, and is disposed downstream of the corresponding photosensitive drum 1 in the moving direction of the intermediate transfer belt 10.

Furthermore, the metal rollers 14 and the opposed roller 13 are connected to an electric ground through a zener diode 15 serving as a constant voltage element. By having the secondary transfer roller 20, to which a voltage has been applied from the transfer power supply 21, supply an electric current to the opposed roller 13, the electric current flows to the zener diode 15 through the opposed roller 13.

The zener diode 15 serving as the constant voltage element is an element that maintains a predetermined voltage (hereinafter, referred to as a zener voltage) by having an electric current flow therethrough, and a zener voltage is generated on a cathode side when a specific amount of electric current or more flows. In the configuration of the present exemplary embodiment, a first end side (an anode side) of the zener diode 15 is connected to an electric ground, and a second end side (the cathode side) is connected to the metal rollers 14 and the opposed roller 13. Accordingly, when a voltage is applied from the transfer power supply 21 to the secondary transfer roller 20, the zener voltage is maintained in the metal rollers 14 and the opposed roller 13.

In the present exemplary embodiment, primary transfer of the toner image is performed with the electric current flowing to each photosensitive drum 1 from the opposed roller 13 maintained at the zener voltage and through the intermediate transfer belt 10, and the electric current flowing towards each photosensitive drum 1 from the corresponding metal rollers 14 maintained at the zener voltage. In so doing, in order to obtain a desired primary transfer efficiently, the zener voltage is set to 300 [V] in the present exemplary embodiment.

Figure 2A:
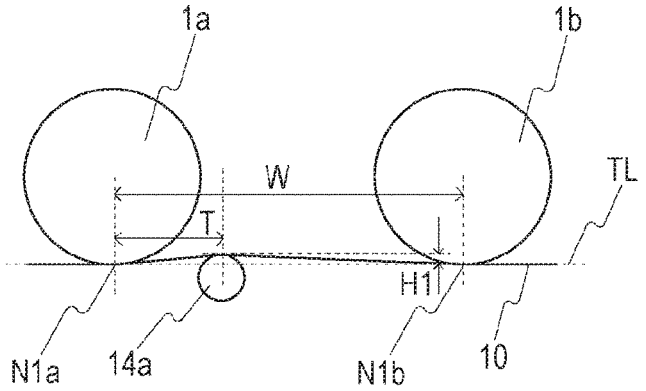
FIG. 2A is a schematic diagram in which image forming units of the first exemplary embodiment has been enlarged.

FIG. 2A is a schematic diagram of the present exemplary embodiment in which a portion between the image forming unit a to the image forming unit b has been enlarged. As illustrated in FIG. 2A, the metal roller 14*a* is, in the moving direction of the intermediate transfer belt 10, disposed downstream of the primary transfer portion formed by the photosensitive drum 1*a* and the intermediate transfer belt 10 being in contact with each other. Furthermore, the metal roller 14*a* is disposed at a position that is closer to the photosensitive drum 1*a* that corresponds to the metal roller 14*a* than to the photosensitive drum 1*b* that is adjacent to the metal roller 14*a* on the downstream side in the moving direction of the intermediate transfer belt 10. Moreover, the metal roller 14*a* is disposed so as to allow the intermediate transfer belt 10 to curl a certain amount on the photosensitive drum 1*a*. When a virtual line TL is defined as a line connecting the positions where the photosensitive drum 1*a* and the photosensitive drum 1*b* are in contact with the intermediate transfer belt 10, the metal roller 14*a* is disposed at a position where, with respect to the virtual line TL, the metal roller 14*a* enters the photosensitive drum 1*a* side.

Herein, W is defined as a distance between a shaft center of the photosensitive drum 1*a* and a shaft center of the photosensitive drum 1*b*, and T is defined as a distance between the shaft center of the photosensitive drum 1*a* and a shaft center of the metal roller 14*a*. Furthermore, H1 is defined as a lifted height of the metal roller 14*a* with respect to the virtual line TL connecting the position where the photosensitive drum 1*a* is in contact with the intermediate transfer belt 10 and the position where the photosensitive drum 1*b* is in contact with the intermediate transfer belt 10. In the present exemplary embodiment, W=50 mm, T=10 mm, and H1=2 mm are satisfied.

While the description has been given using the image forming unit a, values that are the same as those of the first image forming unit a are set for the image forming units b to d as well regarding the value of the distance W between the photosensitive drums 1, the value of the distance T between each photosensitive drum 1 and the corresponding metal roller 14, and the value of the lifted height H1 of each to the metal rollers 14. In other words, the photosensitive drums 1 are disposed at equal intervals, that is, at distance W, and each of the metal rollers 14 and the corresponding one of the photosensitive drums 1 are all disposed, with respect to each other, at the same distance T. Similarly, each of the metal rollers 14 are disposed at the lifted height H1 with respect to the virtual line TL that connects the positions where the photosensitive drums 1 and the intermediate transfer belt 10 are in contact with each other.

Figure 2B:
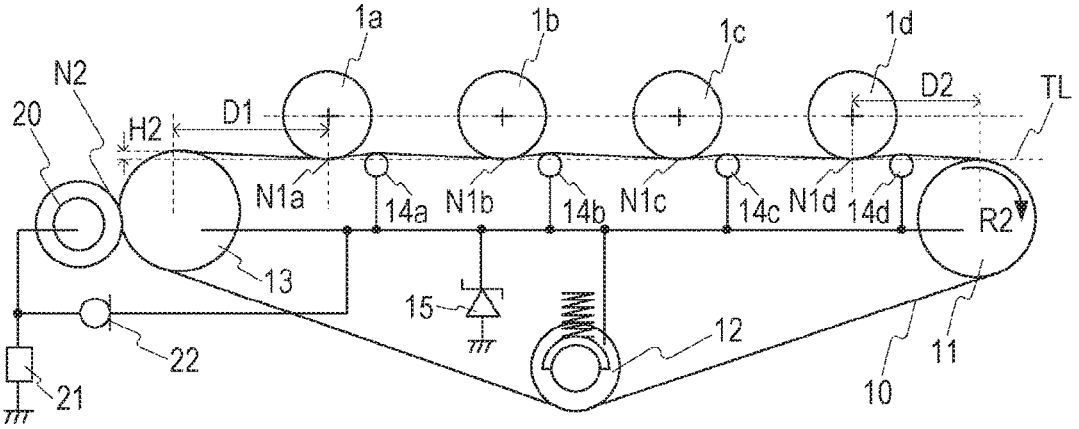
FIG. 2B is a schematic cross-sectional view illustrating a positional configuration of members of the first exemplary embodiment.

FIG. 2B is a schematic diagram illustrating a positional configuration of the members of the image forming apparatus of the present exemplary embodiment. As illustrated in FIG. 2B, D1 is defined as the distance between a shaft center of the opposed roller 13 and the shaft center of the photosensitive drum 1*a*, and D2 is defined as the distance between a shaft center of the photosensitive drum 1*d* and a shaft center of the driving roller 11. Moreover, H2 is defined as a lifted height of the opposed roller 13 with respect to the virtual line TL connecting the positions where the photosensitive drums 1 are in contact with the intermediate transfer belt 10. In the above, D1=40 mm, D2=30 mm, and H2=2 mm are satisfied, and the lifted height of the driving roller 11 with respect to the virtual line TL is 0 mm.

Constant Current Diode

In a configuration in which the transfer power supply is commonly used for primary transfer and secondary transfer and in which primary transfer is performed by distributing an electric current in the circumferential direction of the intermediate transfer belt by applying a voltage to the secondary transfer roller from the commonly used transfer power supply, the following issue may occur. In other words, when the electric current flowing through the primary transfer portion is insufficient, there may be a deficiency in the primary transfer.

For example, when a toner image is secondarily transferred on a transfer material, such as a hygroscopic sheet, that has low electric resistance, the electric current flowing from the secondary transfer roller to the opposed roller with the transfer material in between leaks to another member and the electric current flowing to the primary transfer portion tends to become insufficient. Furthermore, when a toner image is secondarily transferred to a transfer material with high resistance, the electric current flowing through the primary transfer portion may become insufficient due to the delay in the output response of the voltage from the transfer power supply. Conversely, if a large voltage is applied from the start from the transfer power supply to the secondary transfer roller so that the electric current flowing through the primary transfer portion does not become insufficient, the electric current flowing through the secondary transfer portion may become excessive and a deficiency in the secondary transfer may occur.

Accordingly, as illustrated in FIG. 1, in the configuration of the image forming apparatus of the present exemplary embodiment, a current path that does not connect with the secondary transfer roller 20, and that electrically connects the transfer power supply 21 and the metal rollers 14 to each other through a constant current diode 22 serving as a constant current element is provided. The constant current diode 22 is disposed so that an anode side thereof is connected to the transfer power supply 21, and a cathode side thereof is connected to the metal rollers 14.

Figure 3:
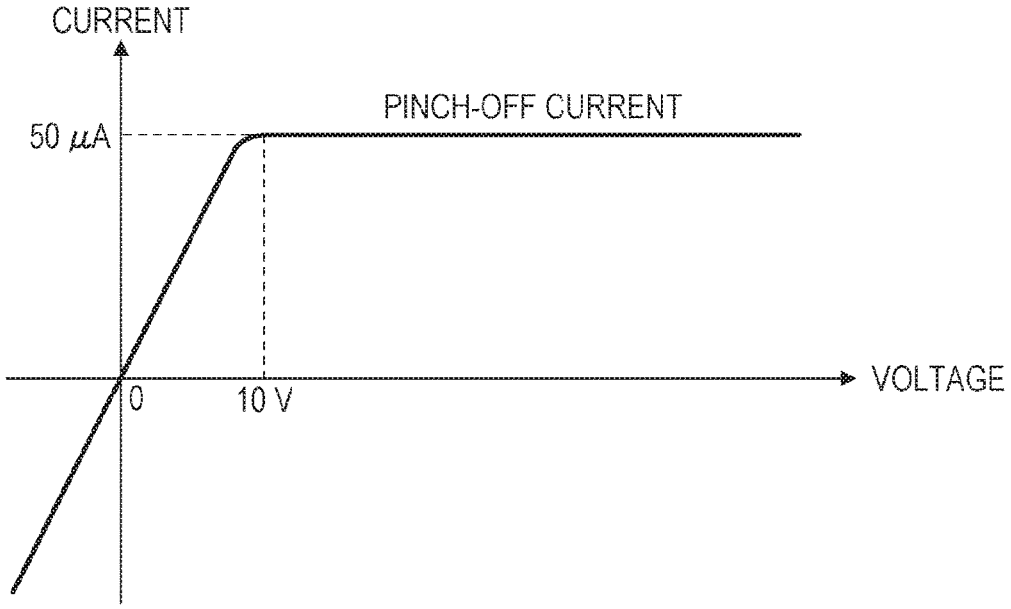
FIG. 3 is a schematic diagram illustrating an electrical characteristic of a constant current diode of the first exemplary embodiment.

The constant current diode 22 is a member that distributes an electric current (a pinch-off current) of a predetermined value when a voltage equivalent to or higher than a predetermined voltage is applied on the anode side. FIG. 3 is a schematic diagram illustrating an electrical characteristic of the constant current diode 22 of the present exemplary embodiment. As illustrated in FIG. 3, the constant current diode 22 distributes a pinch-off current of 50 μA towards the metal rollers 14 when a voltage of 10V or higher is applied on the anode side. Furthermore, when a voltage having a negative polarity is applied to the anode side of the constant current diode 22, an electric current in proportion to the size of the voltage applied to the constant current diode 22 flows towards the electric ground from each of the metal rollers 14 through the constant current diode 22.

As illustrated in FIG. 1, in the configuration of the present exemplary embodiment, when a voltage is applied to the secondary transfer roller 20 from the transfer power supply 21, other than an electric current It2 flowing towards the secondary transfer portion N2, a pinch-off current Id flows through the constant current diode 22. In the constant current diode 22 used in the present exemplary embodiment, the voltage reaching the pinch-off current Id is 10 V, which is a voltage lower than the voltage applied to the secondary transfer roller 20 from the transfer power supply 21 when the image forming operation is performed. Accordingly, when a voltage is applied to the secondary transfer roller 20 from the transfer power supply 21 to form an image, the pinch-off current Id flows through the constant current diode 22.

With the above, the electric current flowing through the primary transfer portions N1 can be prevented from becoming insufficient, and a satisfactory primary transfer characteristic can be obtained. As the constant current diode 22, a constant current diode in which the current that is fed to the primary transfer portions N1 becomes a current that allows the toner image to be primarily transferred from the photosensitive drums 1 to the intermediate transfer belt 10 in an appropriate manner according to the configuration and control of the image forming apparatus may be appropriately used. Note that the electric current fed to the primary transfer portions N1 is the sum of the electric current fed to the primary transfer portions N1 through the secondary transfer roller 20 and the pinch-off current Id of the constant current diode 22. Furthermore, the electric current flowing through the secondary transfer roller 20 is the electric current that flows from the secondary transfer roller 20 to the intermediate transfer belt 10 in the circumferential direction, and the electric current that flows from the metal rollers 14 to the primary transfer portions N1 through the opposed roller 13.

The constant current diode 22 is used in the configuration of the present exemplary embodiment; however, not limited to the constant current diode 22, a constant current circuit may be provided at the position where the constant current diode 22 has been disposed while obtaining an effect similar to that of the present exemplary embodiment. However, a configuration having a constant current circuit is generally complex in many cases; accordingly, as in the present exemplary embodiment, by providing the constant current diode 22, satisfactory primary transfer characteristics can be obtained with a simpler configuration.

Note that in the configuration of the present exemplary embodiment, the constant current diode 22 is disposed in the current path that does not connect with the secondary transfer roller 20. With the above, the electric current It2 that flows towards the secondary transfer roller 20 can be calculated by subtracting 50 μA that is the pinch-off current Id of the constant current diode 22 from an electric current I detected by an electric current detection unit (not shown) of the transfer power supply 21. In other words, constant current control of the electric current flowing through the secondary transfer portion N2 can be performed, and a defect in the secondary transfer due to an insufficient or excess electric current in the secondary transfer portion N2 can be prevented from occurring.

Furthermore, in the present exemplary embodiment, the zener diode 15 that is a constant voltage element is disposed in the current path where the electric current flows from the transfer power supply 21 to the metal rollers 14. In other words, by having the electric current flowing from the metal rollers 14 through the constant current diode 22 be fed to the zener diode 15, the cathode side of the zener diode 15 can be maintained at the zener voltage. Accordingly, for example, in a case in which a small-sized transfer material P is conveyed through the secondary transfer portion N2, even when the electric current flowing through the primary transfer portions N1 are excessive, the opposed roller 13 and the metal rollers 14 are maintained at the zener voltage. With the above, a defect in the primary transfer due to excessive electric current flowing through the primary transfer portions N1 can be prevented from occurring.

Furthermore, in the present exemplary embodiment, since the opposed roller 13 and the metal rollers 14 are electrically connected to each other and the electric current is fed to the primary transfer portions N1 from both sides, namely, from the secondary transfer roller 20 side and the constant current diode 22 side, the electric current I flowing through the transfer power supply 21 can be fed efficiently to the primary transfer portions N1. When the opposed roller 13 and the metal rollers 14 are not electrically connected to each other, the electric current is fed to the primary transfer portion N1 from only the constant current diode 22 side. In such a case, primary transfer is achieved by having the pinch-off current Id of the constant current diode 22 compensate for the electric current needed for the primary transfer. However, in such a case, compared with a case in which the opposed roller 13 and the metal rollers 14 are electrically connected to each other, a constant current diode in which a lager pinch-off current Id flows needs to be used and the current capacity of the transfer power supply 21 needs to be increased at the same time. As a result, the cost and the size of the transfer power supply 21 may increase.

In the present exemplary embodiment, the zener diode 15 is used as the constant voltage element connecting the opposed roller 13 and the metal rollers 14; however, not limited to the zener diode 15, a resistance element or a varistor may be used. Furthermore, the zener diode 15 may not be used and the electric current can be fed through the intermediate transfer belt 10 to the photosensitive drums 1 from the secondary transfer roller 20 to which a voltage has been applied from the transfer power supply 21.

Furthermore, in the present exemplary embodiment, the metal rollers 14 are used as the contact members; however, not limited to the metal rollers 14, roller members having a conductive elastic layer, conductive sheet members, conductive brush members, or the like can be used. Furthermore, in the present exemplary embodiment, the metal rollers 14 serving as the contact members are disposed at positions that are in contact with the inner peripheral surface of the intermediate transfer belt 10; however, not limited to the above positions, the metal rollers 14 may be disposed at positions that are in contact with the outer peripheral surface of the intermediate transfer belt 10.

Second Exemplary Embodiment

Figure 4:
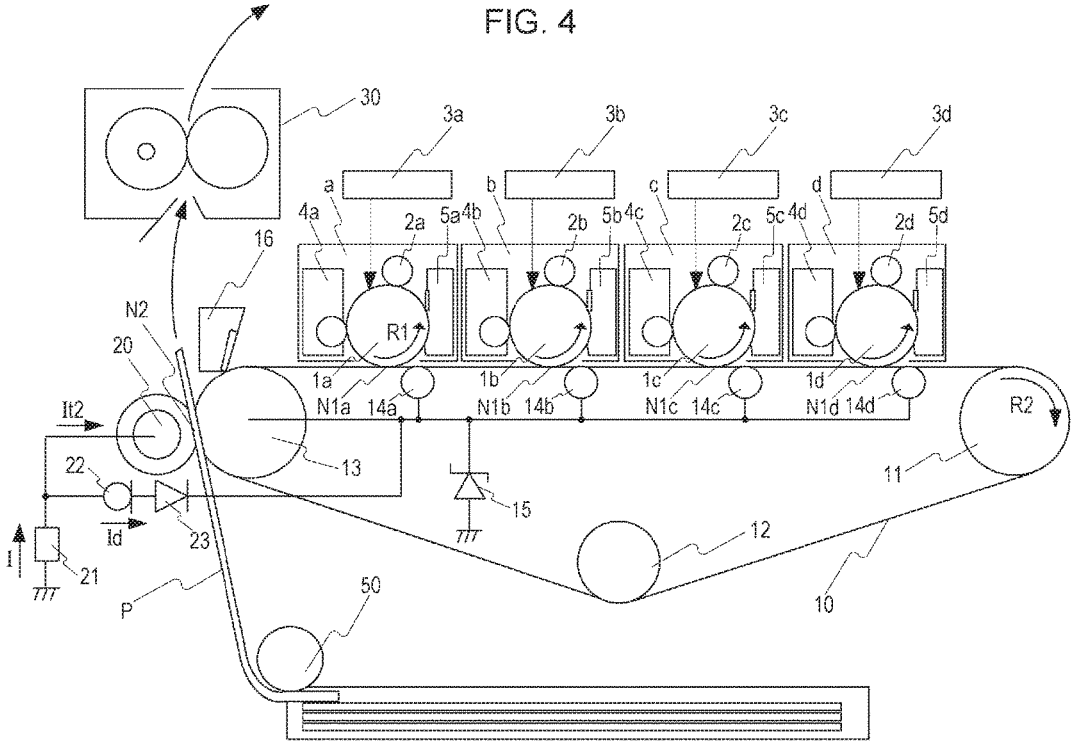
FIG. 4 is a schematic cross-sectional view illustrating an image forming apparatus according to a second exemplary embodiment.

In the first exemplary embodiment, a configuration in which the constant current diode 22 is disposed in the current path that electrically connecting the transfer power supply 21 and the metal rollers 14 to each other has been described. In the second exemplary embodiment, as illustrated in FIG. 4, a configuration in which a rectifier diode 23 that has a rectification function is disposed between the constant current diode 22 and the metal rollers 14 is described. FIG. 4 is a schematic cross-sectional view illustrating a configuration of an image forming apparatus of the present exemplary embodiment. Note that in the description hereinafter, portions that are common with those of the first exemplary embodiment are denoted with the same reference numerals as those of the first exemplary embodiment and description thereof is omitted.

By applying a voltage that has a polarity (a negative polarity in the present exemplary embodiment) that is the same as the normal charge polarity of the toner to the secondary transfer roller 20, the transfer power supply 21 suppresses attachment of toner on the secondary transfer roller 20 and performs a cleaning operation on the secondary transfer roller 20.

For example, in a case in which the image forming operation is stopped due to the transfer material P stagnating in the conveyance path of the transfer material P, a voltage having a negative polarity is applied to the secondary transfer roller 20 from the transfer power supply 21 to collect the residual toner on the intermediate transfer belt 10 with the belt cleaning unit 16. With the above, the back surface of the succeeding transfer material P being smudged by toner due to attachment of the toner on the secondary transfer roller 20 can be prevented. Furthermore, in a case in which a detection toner image that is not transferred to the transfer material P is primarily transferred to the intermediate transfer belt 10, by applying a voltage having a negative polarity to the secondary transfer roller 20 from the transfer power supply 21, the detection toner image can pass through the secondary transfer portion N2 and be collected at the belt cleaning unit 16.

Moreover, in a case in which toner having a negative polarity is attached to the secondary transfer roller 20 from the intermediate transfer belt 10 during an image forming operation, a cleaning operation that discharges the toner having a negative polarity from the secondary transfer roller 20 needs to be performed after the image forming operation has ended. In performing cleaning of the secondary transfer roller 20, a voltage having a negative polarity is applied from the transfer power supply 21 to the secondary transfer roller 20. By so doing, the toner attached on the secondary transfer roller 20 can be moved to the intermediate transfer belt 10. The toner moved to the intermediate transfer belt 10 is, subsequently, collected by the belt cleaning unit 16 and the cleaning operation of the secondary transfer roller 20 is completed.

As described above, in a case in which a voltage having a negative polarity is applied from the transfer power supply 21 to the secondary transfer roller 20, when the absolute value of the electric current flowing towards the transfer power supply 21 from the metal rollers 14 through the constant current diode 22 is large, the output voltage of the transfer power supply 21 may become decreased.

Accordingly, in the present exemplary embodiment, as illustrated in FIG. 4, the rectifier diode 23 that is capable of blocking the electric current flowing towards the transfer power supply 21 from the metal rollers 14 through the constant current diode 22 when a voltage with a negative polarity is output from the transfer power supply 21 is provided. An anode side of the rectifier diode 23 is connected to the cathode side of the constant current diode 22, and a cathode side of the rectifier diode 23 is electrically connected to the metal rollers 14 and the opposed roller 13.

With the above configuration, when a voltage having a negative polarity is applied from the transfer power supply 21 to the secondary transfer roller 20, the electric current flowing from the metal rollers 14 towards the transfer power supply 21 through the constant current diode 22 can be blocked. On the other hand, when a voltage having a positive polarity is applied from the transfer power supply 21 to the secondary transfer roller 20, the rectifier diode 23 can distribute the pinch-off current Id of the constant current diode 22 to the primary transfer portions N1.

As described above, with the configuration of the present exemplary embodiment, not only an effect similar to that of the first exemplary embodiment can be obtained but also a decrease in the output voltage of the transfer power supply 21 can be suppressed when a voltage having a negative polarity is output from the transfer power supply 21. Furthermore, when a voltage having a negative polarity is output from the transfer power supply 21, damage in the constant current diode 22 due to an excessive electric current flowing in from the metal rollers 14 to the transfer power supply 21 through the constant current diode 22 can be prevented.

Modification Example

Figure 5:
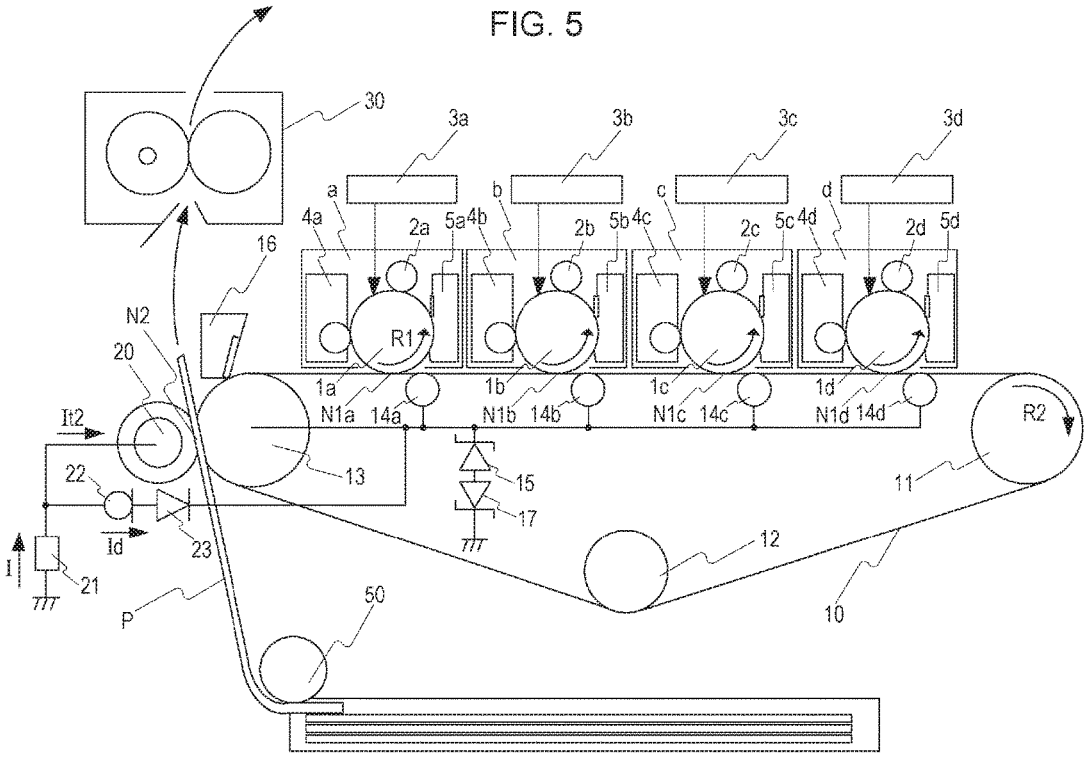
FIG. 5 is a schematic cross-sectional view illustrating an image forming apparatus that is a modification example of the second exemplary embodiment.

FIG. 5 is a schematic cross-sectional view illustrating a configuration of an image forming apparatus serving as a modification example of the second exemplary embodiment. As illustrated in FIG. 5, in the modification example, a zener diode 17 is disposed in which the zener diode 17 is connected a negative direction at a portion between the anode side of the zener diode 15 connected in a positive direction and the electric ground. More specifically, an anode side of the zener diode 17 is connected to the anode side of the zener diode 15, and a cathode side is connected to an electric ground. The zener voltage of the zener diode 17 is 500 V.

In a case in which the image formation operation is stopped due to a stagnating transfer material P in the conveyance path of the transfer material P, toner images may remain not only on the intermediate transfer belt 10 but also on the photosensitive drums 1. In the configuration of the second exemplary embodiment, when a voltage having a negative polarity is output from the transfer power supply 21, a potential having a negative polarity is not formed in the metal rollers 14 and the opposed roller 13 since the zener diode 15 connected in the positive direction is disposed. In such a case, when some of the residual toner on the photosensitive drums 1 moves to the intermediate transfer belt 10 due to electric fields formed in the primary transfer portions N1, the time executing the cleaning operation to collect the toner remaining on the intermediate transfer belt 10 becomes long.

Accordingly, in the present modification example, by provided a zener diode 17 in the negative direction, when a voltage having a negative polarity is output from the transfer power supply 21, the metal rollers 14 and the opposed roller 13 that are connected to the zener diode 17 in the negative direction are maintained at −500 V, which is a zener voltage. As a result, the toner remaining on the photosensitive drums 1 can be suppressed from, due to the electric fields formed in the primary transfer portions N1, moving to the intermediate transfer belt 10, and increase in the time in which the cleaning operation is executed can be suppressed.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2017-199624, filed Oct. 13, 2017, which is hereby incorporated by reference herein in its entirety.

What is claimed is:

1. An image forming apparatus comprising:

an image carrying member configured to carry a toner image;

an endless and movable intermediate transfer belt having conductivity, the toner image on the image carrying member being primarily transferred to the intermediate transfer belt;

a secondary transfer member in contact with an outer peripheral surface of the intermediate transfer belt, and configured to secondarily transfer the toner image from the intermediate transfer belt to a transfer material;

a power supply configured to apply a voltage to the secondary transfer member, the toner image being primarily transferred from the image carrying member to the intermediate transfer belt by having a voltage be applied to the secondary transfer member from the power supply;

a contact member configured to contact with the intermediate transfer belt; and a constant current diode, an anode side of the constant current diode being connected to the power supply, and a cathode side of the constant current diode being connected to the contact member.

2. The image forming apparatus according to claim 1, wherein the constant current diode is provided in a current path that does not connect with the secondary transfer portion.

3. The image forming apparatus according to claim 1, further comprising:

a rectifier diode provided in a current path connecting the constant current diode and the contact member to each other while in a state in which an anode side of the rectifier diode is connected to the cathode side of the constant current diode, and a cathode side of the rectifier diode is connected to the contact member.

4. The image forming apparatus according to claim 1, further comprising:

an opposing member that opposes the secondary transfer member with the intermediate transfer belt interposed between; and a constant voltage element capable of maintaining a predetermined voltage by having an electric current fed thereto;

wherein a first end side of the constant voltage element is connected to an electric ground, and a second side of the constant voltage element is connected to the opposing member and the contact member.

5. The image forming apparatus according to claim 4, wherein the constant voltage element maintains the opposing member and the contact member at a predetermined voltage with an electric current flowing from the secondary transfer member, to which a voltage having a predetermined polarity has been applied by the power supply, to the opposing member through the constant voltage element.

6. The image forming apparatus according to claim 4, wherein in a state in which a voltage having a predetermined polarity is applied to the secondary transfer member from the power supply, the constant voltage element maintains the opposing member and the contact member at a predetermined voltage with an electric current flowing in the contact member through the constant current diode.

7. The image forming apparatus according to claim 4, wherein the constant voltage element is a zener diode in which an anode side is connected to an electric ground, and a cathode side is connected to the opposing member and the contact member.

8. The image forming apparatus according to claim 4, wherein the constant voltage element includes a first zener diode and a second zener diode, and wherein a cathode side of the first zener diode is connected to the opposing member and the contact member, an anode side of the first zener diode is connected to an anode side of the second zener diode, and a cathode side of the second zener diode is connected to an electric ground.

9. The image forming apparatus according to claim 1, wherein by applying a voltage having a predetermined polarity from the power supply to the secondary transfer member, a toner image is primarily transferred from the image carrying member to the intermediate transfer belt, and the toner image that has been primarily transferred to the intermediate transfer belt is secondarily transferred to a transfer material.

10. The image forming apparatus according to claim 1, wherein the contact member is a metal roller and is, in a moving direction of the intermediate transfer belt, disposed downstream with respect to a position where the image carrying member and the intermediate transfer belt are in contact with each other.

11. An image forming apparatus comprising:

an image carrying member configured to carries a toner image;

an endless and movable intermediate transfer belt having conductivity, the toner image on the image carrying member being primarily transferred to the intermediate transfer belt;

a secondary transfer member in contact with an outer peripheral surface of the intermediate transfer belt, the secondary transfer member secondarily transferring the toner image on the intermediate transfer belt to a transfer material;

a power supply configured to applies a voltage to the secondary transfer member, the toner image being primarily transferred from the image carrying member to the intermediate transfer belt by having a voltage be applied to the secondary transfer member from the power supply;

a contact member in contact with the intermediate transfer belt; and a constant current circuit provided in a current path that does not connect with the secondary transfer member and that electrically connects the power supply and the contact member to each other.

12. The image forming apparatus according to claim 11, wherein the constant current circuit is a constant current diode in which an anode side is connected to the power supply, and a cathode side is connected to the contact member.

13. The image forming apparatus according to claim 11, further comprising:

a rectifier diode provided in a current path connecting the constant current circuit and the contact member to each other while in a state in which an anode side of the rectifier diode is connected to the constant current circuit, and a cathode side of the rectifier diode is connected to the contact member.

14. The image forming apparatus according to claim 11, further comprising:

an opposing member configured to opposes the secondary transfer member with the intermediate transfer belt interposed therebetween; and a constant voltage element that is capable of maintaining a predetermined voltage by being fed an electric current, a first end side of the constant voltage element being connected to an electric ground, and a second end side of the constant voltage element being connected to the opposing member and the contact member.

15. The image forming apparatus according to claim 14, wherein in a state in which a voltage having a predetermined polarity is applied to the secondary transfer member from the power supply, the constant voltage element maintains the opposing member and the contact member at a predetermined voltage with an electric current flowing in the contact member through the constant current circuit.

16. The image forming apparatus according to claim 14, wherein the constant voltage element is a zener diode in which an anode side is connected to an electric ground, and a cathode side is connected to the opposing member and the contact member.

17. The image forming apparatus according to claim 14, wherein the constant voltage element includes a first zener diode and a second zener diode, and wherein a cathode side of the first zener diode is connected to the opposing member and the contact member, an anode side of the first zener diode is connected to an anode side of the second zener diode, and a cathode side of the second zener diode is connected to an electric ground.

18. The image forming apparatus according to claim 11, wherein by applying a voltage having a predetermined polarity from the power supply to the secondary transfer member, a toner image is primarily transferred from the image carrying member to the intermediate transfer belt, and the toner image that has been primarily transferred to the intermediate transfer belt is secondarily transferred to a transfer material.

19. The image forming apparatus according to claim 11, wherein the contact member is a metal roller and is, in a moving direction of the intermediate transfer belt, disposed downstream with respect to a position where the image carrying member and the intermediate transfer belt are in contact with each other.

* * * * *